US006658767B2

(12) United States Patent
Kelly et al.

(10) Patent No.: US 6,658,767 B2
(45) Date of Patent: Dec. 9, 2003

(54) TRENCHING METHOD AND APPARATUS

(75) Inventors: Keith R. Kelly, Warsop (GB); Jack Geelhoed, Wyberton Fen (GB)

(73) Assignee: Mastenbroek Ltd., Boston (GB)

( * ) Notice: Subject to any disclaimer, the term of this patent is extended or adjusted under 35 U.S.C. 154(b) by 0 days.

(21) Appl. No.: 09/987,203

(22) Filed: Nov. 13, 2001

(65) Prior Publication Data

US 2002/0056211 A1 May 16, 2002

Related U.S. Application Data

(63) Continuation-in-part of application No. PCT/GB01/04664, filed on Oct. 19, 2001.

(30) Foreign Application Priority Data

Oct. 23, 2000 (GB) ..... 0025899

(51) Int. Cl.[7] ..... E02F 5/00

(52) U.S. Cl. ..... 37/347; 37/348; 37/352; 37/355; 37/357

(58) Field of Search ..... 37/347, 348, 352, 37/353–362, 364, 365

(56) References Cited

U.S. PATENT DOCUMENTS

| | | | | |
|---|---|---|---|---|
| 1,769,074 | A | 7/1930 | Ruatti | |
| 3,967,396 | A | 7/1976 | Hubert et al. | |
| 4,173,836 | A | 11/1979 | Paurat | 37/81 |
| 4,230,372 | A | 10/1980 | Marten | 299/39 |

(List continued on next page.)

FOREIGN PATENT DOCUMENTS

| | | |
|---|---|---|
| CH | 239498 | 1/1946 |
| DE | 32 07 104 | 9/1983 |
| DE | 34 39 518 | 6/1985 |
| DE | 39 11 624 A1 | 10/1990 |
| DE | 40 18 086 A1 | 5/1992 |
| DE | 42 13 523 | 10/1993 |
| EP | 0 080 802 | 6/1983 |
| EP | 0 593 355 A1 | 4/1994 |
| GB | 832001 | 8/1958 |
| GB | 2 133 436 A | 7/1984 |

(List continued on next page.)

OTHER PUBLICATIONS

DOSCO 1982, "The Twin Boom TB 600," by Hawker Siddeley, DOSCO Overseas Engineering Ltd.

DOSCO 1982, "Mk 2 Heavy Duty Dintheader," by Hawker Siddeley, DOSCO Overseas Engineering Ltd.

A copy of the PCT Search Report dated Oct. 23, 2000, issued in the corresponding PCT Application No. PCT/GB01/04664.

*Primary Examiner*—Christopher J. Novosad
(74) *Attorney, Agent, or Firm*—Pillsbury Winthrop LLP

(57) ABSTRACT

Trenching apparatus comprises a cutting device, preferably an endless chain cutter, mounted on a prime mover for positioning the cutting device in a trench with the prime mover movable on the ground surface above the level of the trench. Where the cutting device is a chain cutter, the boom projects forwardly and downwardly relative to the direction of cutting the trench, and drive unit arranged to drive the chain in a direction to carry the cutting elements upwardly around the distal end of the boom and rearwardly along the upper run of the endless chain cutter. In operation the distal end of the chain cutter is positioned against the end face of the trench at the bottom of the trench; the prime mover moves the chain cutter forwardly in the trench while operating the chain cutter, so as to produce an undercut in the end face of the trench; and the lifting device lifts the cutting device upwardly from the undercut through the material of the end face so as to cut material from the end face of the trench.

84 Claims, 9 Drawing Sheets

U.S. PATENT DOCUMENTS

| | | | | |
|---|---|---|---|---|
| 4,755,001 | A | 7/1988 | Gilbert | |
| 4,908,967 | A | 3/1990 | Leece | 37/192 A |
| 5,056,242 | A | 10/1991 | Miotti | 37/94 |
| 5,074,063 | A | 12/1991 | Vannette | 37/191 A |
| 5,586,399 | A | 12/1996 | Staroselsky | 37/351 |
| 5,671,554 | A | 9/1997 | Geelhoed | 37/348 |
| 5,701,691 | A | 12/1997 | Watanabe et al. | 37/348 |
| 5,707,175 | A | 1/1998 | Geelhoed | 405/180 |
| 5,735,065 | A | 4/1998 | Yamagata et al. | 37/348 |
| 5,735,066 | A | 4/1998 | Tochizawa et al. | 37/348 |
| 6,016,616 | A | 1/2000 | Geelhoed | 37/348 |

FOREIGN PATENT DOCUMENTS

| | | |
|---|---|---|
| JP | 57-137531 | 8/1982 |
| JP | 58-76622 | 5/1983 |
| JP | 60-250129 | 12/1985 |
| SU | 222973 | 10/1968 |
| WO | WO90/04068 | 4/1990 |
| WO | WO95/13433 | 5/1995 |
| WO | WO97/16606 | 5/1997 |
| WO | WO97/48860 | 12/1997 |
| WO | WO99/00555 | 1/1999 |

TRENCHING METHOD AND APPARATUS

This is a Continuation-In-Part Application of International Application No. PCT/GB01/04664, filed Oct. 19, 2001, the contents of which are incorporated into this application by reference.

The present invention relates to a method of trenching, and to a trenching apparatus, both of which are applicable in particular, but not exclusively, for cutting a trench in rock.

There are known many trenching machines for digging trenches in soil by use of a prime mover such as a crawler tractor, or a conventional tractor pulling a trailer, in which a cutting device is positioned in the trench on a boom. The main examples are a cutting rotor rotating about an axis transverse to the trench, known as a ripper cutter, or one or more cutting rotors rotating about an axis aligned along the length of the boom, generally known as a milling cutter, or a cutting device having an elongate endless support means carrying a plurality of cutting elements and trained along upper and lower runs on the boom, known as a chain cutter. Where a cutting rotor is used this is mounted on the distal end of a boom projecting forwardly and downwardly from the prime mover, relative to the direction of digging of the trench Where a chain cutter is used, this is normally mounted on a boom extending downwardly and rearwardly from the prime mover relative to the direction of cutting of the trench. In such an arrangement the elongate support member moves in a direction such that the cutting elements move downwardly around the distal end of the boom and upwardly and forwardly along the lower run of the moving elongate support member. There is normally provided in all these forms of trenching machines, a positioning device for raising and lowering the distal end of the cutting boom to vary the height of the trench. Examples of such trenching machines are found in, for example, CH-A-239495 (Entreprise de Grands Travaux SA), and WO 95/13433 (Mastenbroek & Company Limited).

All these forms of trenching machine are generally satisfactory for trench cutting in normal soil conditions, but are not suitable fur cutting trenches in rock or other hard ground materials. For cutting trenches in hard rock, labour intensive methods are generally adopted using percussion tools and explosives.

In another art unconnected with trenching, tunnelling machines for tunnelling into rock are known in which a cutting rotor known as a ball cutter protrudes forwardly on a boom from a prime mover, and is movable in a vertical plane by pivoting of the boom on the prime mover. In use the cutting rotor is lowered to the floor of the tunnel and the prime mover advances with the cutting rotor to engage the end face of the tunnel at floor level, to produce an undercut. The cutting boom is then pivoted in an upward direction by hydraulic rams so that the cutting rotor or rotors are lifted upwardly to cut a slice of material from the end face of the tunnel. The cutting boom is raised by application of a force between the cutting boom and the floor of the tunnel. In a variation of such a device, there is provided a form of chain cutter trained along upper and lower runs along the cutting boom and around the distal end of the cutting boom, for use for example in mining coal or soft stone. In such a machine the endless moving support means carrying the cutters is driven in a direction such that the cutters move upwardly around the distal end of the boom and move rearwardly along the upper run of the moving support member. Examples of both forms of tunnelling equipment are found in leaflets published in 1982 by Hawker Sidley Dosco Overseas Engineering Limited and entitled DOSCO 1982 "The Twin Boom TB600" and DOSCO 1982 "Mark II Heavy Duty Dintheader".

In addition to this prior art, there is disclosed in EA-A-008082 (Wallace) a machine for cutting a trench in rock by use of a ripper cutter. EP-A-0080802 also acknowledges as prior art a known trench cutting machine comprises a giant chain saw mounted on a crawler chassis and equipped with tungsten carbide teeth which literally saw away the rock. However, this machine suffers from the disadvantage that considerable bounce is generated along the saw, especially when cutting the harder rooks, and this reduces the cutting efficiency. Primarily the problem arises because of the long unsupported length of the cutting arm. There is also discussion in EP-A-0080802 of ball cutting machines such as have been described above in tunnelling, and it is said that other rock cutting machines are known for face mining operations and these comprise a rotatable cutting head carried at the end of a boom pivotably attached to a crawler chassis. However, it is said that these known machines cannot be used for cutting trenches and furthermore suffer from a similar vibration problem because they too have a long unsupported boom carrying the cutting head.

In EP-A-0080802 it is said that these difficulties are overcome by providing a machine for cutting a trench in rock having a pivoted boom with a rotatable cutting head at the distal end and a telescopic control arm extending between a mobile work platform and the end of the boom adjacent the cutting head, the telescopic control arm being an hydraulically operable ram serving to move the cutting head on an arcuate path about the pivot axis of the boom. The machine operates by the hydraulic ram applying to the cutting head a force having a major vertical component. In operation the machine is positioned to straddle the line of the trench and the boom is lowered into contact with the ground. The cutting head is rotated whilst applying force by way of the hydraulic ram to move the cutting head on an arcuate path downwardly and to remove rock from the forward end of the trench. A conveyor is positioned on the floor of the trench and the spoil is carried away. The boom is then raised and the machine moved forward and the process is repeated.

It is said that the problem of vibration and bounce with the relatively long boom is avoided because the position at which the ram is coupled to the boom adjacent to the cutting head adds to the stability of the cutting head so eliminating the vibration and bounce problems which would be expected if the ram were omitted and the cutting force was applied by the long boom. It is said that because the control arm applies the necessary loading of the cutting head, and because of the relatively short distance between the cutting head and the point of support, the problem with cutter head bounce is largely avoided.

However a disadvantage arises with this form of machine, as is acknowledged in EP-A-0080802, in that the force applied at the cutting head tends to lift the machine out of contact with the ground. It is suggested that additional ballast may carried, but it is nevertheless inescapable that there is a limit to the amount of force which can be applied to move the cutting head on its arcuate path, without the surface mounted components of the apparatus lifting from the ground surface.

It is one object of the present invention to provide a trench cutting apparatus in which the problems outlined above are avoided or reduced.

In accordance with the present invention there is provided a method of trenching comprising positioning in a trench a cutting device mounted on a prime mover movable on the ground surface above the trench; engaging an end face of the trench with the cutting device; and moving the cutting device in a vertical plane while operating the cutting device, so as to cut material from the end face of the trench; in which the method includes positioning the cutting device against the end face of the trench below the level of the ground surface, and moving the cutting device forward in the trench while operating the cutting device, so as to produce an undercut in the end face of the trench; and lifting the cutting device upwardly from the undercut by exerting A force between the cutting device and the ground surface above the trench and operating the cutting device during the upward movement so as to cut material from the end face of the trench.

It is to be appreciated that where features of the invention are set out herein with regard to a method according to the invention, such features may also be provided with regard to apparatus according to the invention, and vice versa.

In particular, there is provided in accordance with the invention trenching apparatus comprising a cutting device; mounting means for mounting the cutting device on a prime mover and for positioning the cutting device in a trench with the prime mover movable on the ground surface above the level of the trench, the cutting device being movable in a substantially vertical plane when engaged with an end face of the trench so as to cut material from an end face of the trench; in which the apparatus includes lifting means arranged to lift the cutting device upwardly while operating the putting device in cutting engagement with the end face of the trench, by exerting an upward force between the cutting device and the ground surface above the trench; and in which the cutting device comprises a boom having an elongate endless support means carrying a plurality of cutting elements and trained along upper and lower runs on the boom, the boom being mounted to project forwardly and downwardly relative to the intended direction of cutting the trench, and drive means arranged to drive the endless support means in a direction such as to carry the cutting elements upwardly around the distal end of the boom and rearwardly along the upper run of the endless support means.

In connection with yet a further aspect of the present invention, there may be provided trenching apparatus comprising a cutting device; mounting means for mounting the cutting device on a prime mover and for positioning the cutting device in a trench with the prime mover movable on the ground surface above the level of the trench, the cutting device being movable in a substantially vertical plane when engaged with an end face of the trench so as to cut material from an end face of the trench; in which the apparatus includes lifting means arranged to lift the cutting device upwardly while engaged with the end face of the trench by exerting an upward force between the cutting device and the ground surface above the trench; and control means arranged to operate the lifting mean, and the cutting device concurrently so as to lift the cutting device when in cutting engagement with the end face.

The method of the invention brings the advantage that during the upward cutting stroke the force exerted between the cutting device and the ground surface is limited only by the force generated and applied, and is not limited by potential rising of components of trenching apparatus from the ground as in the prior art where the cutting is effected on the down stroke of the cutting device. It is not necessary to provide substantial weight in the part of the apparatus on which the lifting means is mounted, as would be the case if the lifting means were pressing downwardly on the cutting device during the cutting stroke.

There will now be set out a number of preferred features of the invention. Preferably in the step of producing the undercut the cutting device is positioned to engage the end face substantially at the bottom of the trench. Also preferably the cutting device is mounted on a pivoted boom extending forwardly relative to the direction of cutting of the trench, and the said lifting step is carried out by moving the cutting device along an arcuate path defined by pivotal movement of the boom. In such an arrangement it is preferred that the step of lifting the cutting device upwardly is carried out by exerting a force between the cutting device and a region of the ground surface spaced from the axis of pivoting of the boom in a forward direction along the trench. Also preferably the step of lifting the cutting device upwardly is carried out by exerting a force between the cutting device and the ground surface in a direction substantially perpendicular to the axis of the boom, and the step of lifting the cutting device upwardly is carried out by exerting a force at the distal end of the boom adjacent the cutting device. Preferably the step of lifting the cutting device upwardly is carried out by exerting a force in a direction inclined to the vertical in a direction forwardly relative to the direction of cutting of the trench. Such arrangements add to the stability of the apparatus and allow most effective use of the upward force applied to the cutting device.

Although a number of different culling devices can be used in embodiments of the invention, it is particularly preferred that the step of cutting material from the end face of the trench is carried out by moving a plurality of cutting elements along upper and lower runs of an elongate endless support means trained along the boom, the cutting elements being driven in such a manner that at the distal end of the cutting boom the elements move in a direction upwardly around the and of the cutting boom and rearwardly along the upper run relative to the direction of cutting the trench. Such an arrangement is particularly advantageous because the cutting elements engage the undercut in a direction upwardly and rearwardly at the distal end of the boom so as to cooperate with the lifting force in bringing the cutting teeth into cutting engagement with the ground material. In the case of hard rock this allows an effective cutting action in which the movement of the cutting elements cooperates with the upward movement of the lifting means and the forward movement of the prime mover, during cutting. Also, the upper run of the elongate endless support means can be effective to carry away spoil, so that there is no need to provide a separate endless conveyor, or other means, to remove the spoil from the trench, although such an additional conveyor can be provided behind the chain cutter in some circumstances.

In alternative arrangements, the cutting device may comprise a cutting rotor mounted at the end of a boom, and the step of cutting material from the end face of the trench is carried out by rotating the cutting rotor about an axis aligned transverse to the length of the trench, or by rotating the cutting rotor about an axis aligned generally along the length of the boom.

In preferred forms it may be arranged that tho lifting means is constructed to provide a power stroke in the upward direction and a return stroke in the downward direction, and to provide a greater force in the power stroke than in the return stroke.

Although in some arrangements the lifting means may be mounted on the prime mover, it is preferred that the apparatus includes a mobile base unit spaced forwardly from the prime mover and coupled thereto for movement with the prime mover, the lifting means being mounted so as to exert the said lifting force between the cutting device and the prime mover and/or the mobile base In a particularly preferred form, the mobile base unit is coupled to the prime mover by a framework, and the lifting means includes a pivoted arm pivoted to the prime mover and extending forwardly thereof, a pivoted link coupled at one end to a forward end of the pivoted arm and at the other end to the beam of the cutting device, and a source of lifting power coupled between the arm at a position intermediate the two ends thereof and the framework at a position intermediate the two ends thereof. Preferably the lifting means includes an hydraulic ram.

In accordance with a particularly preferred feature of the invention, the apparatus may include control means programmed to carry out a predetermined operating cycle in which:

(i) the mounting means positions the cutting device against the end face of the trench at the bottom of the trench;

(ii) the prime mover moves the cutting device forwardly a predetermined distance in the trench while operating the cutting device, so as to produce an undercut in the end face of the trench;

(iii) the lifting means lifts the cutting device upwardly from the undercut through the material of the end face while operating the cutting device;

(iv) the prime mover moves the cutting device rearwardly by a predetermined distance;

(v) the lifting means lowers the cutting device to the bottom of the trench; and (vi) the previous steps are repeated.

The base unit may consist of a structure mounted on skids which slide over the ground when propelled forwardly by the prime mover. In other arrangements the base may be mounted upon wheels, or in some cases may be mounted on a second prime mover arranged to cooperate with the first prime mover in moving the cutting device along the trench.

Embodiments of the invention will now be described by way or example with reference to the accompanying drawings in which.

Figure 3:
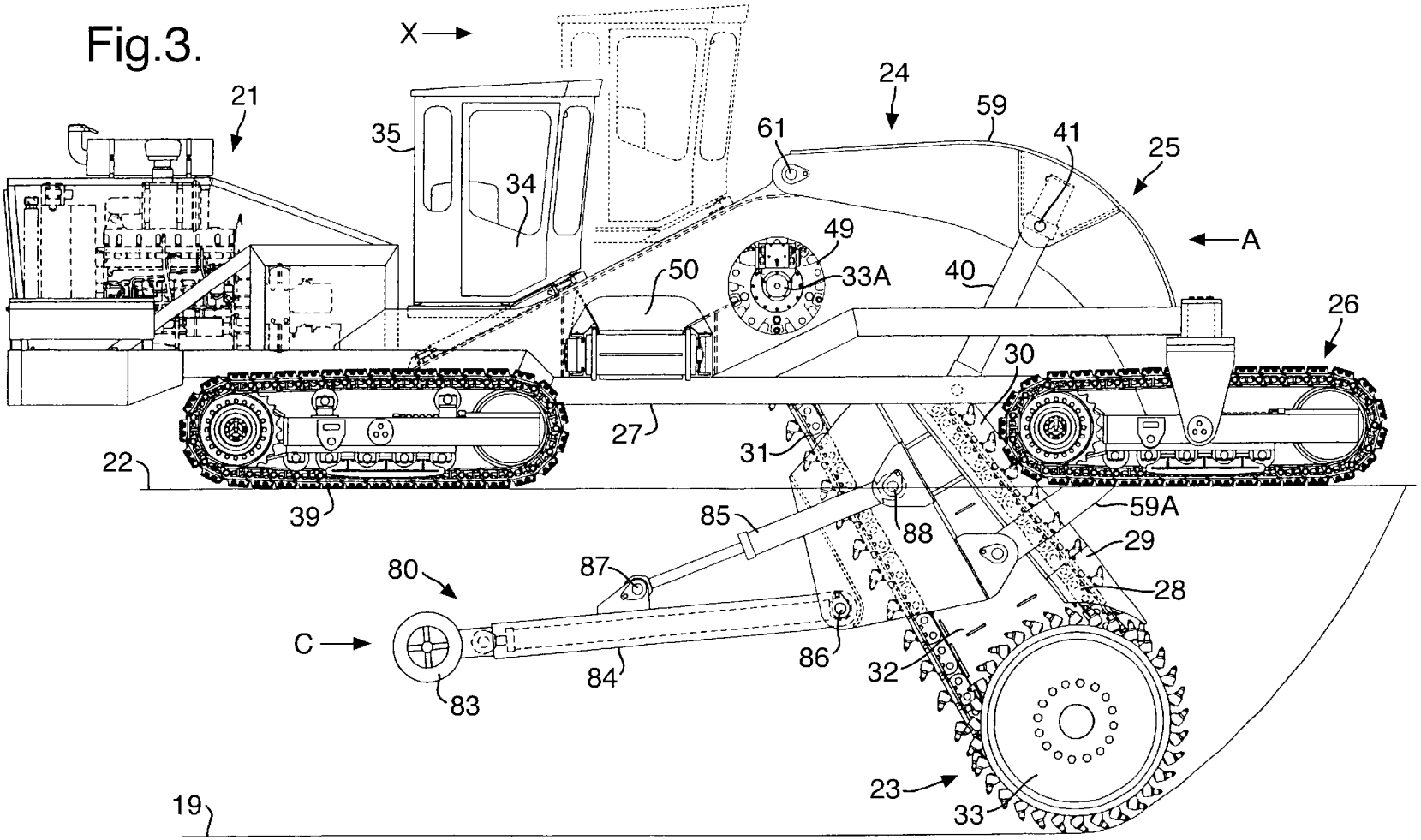
FIG. 3 is a diagrammatic side view of a trench cutting apparatus embodying the present invention and utilising a chain cutter.
Figure 3A:
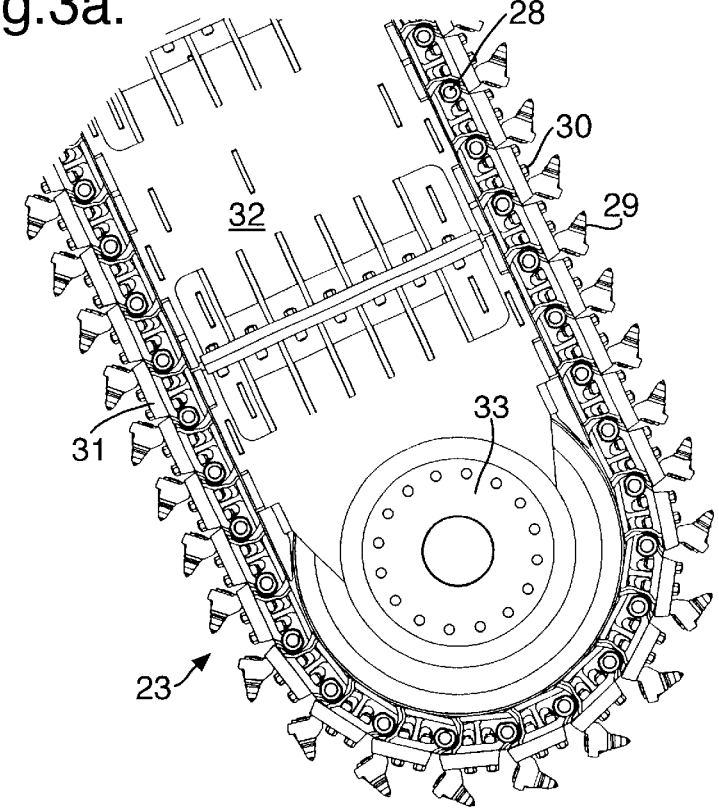
Figure 3B:
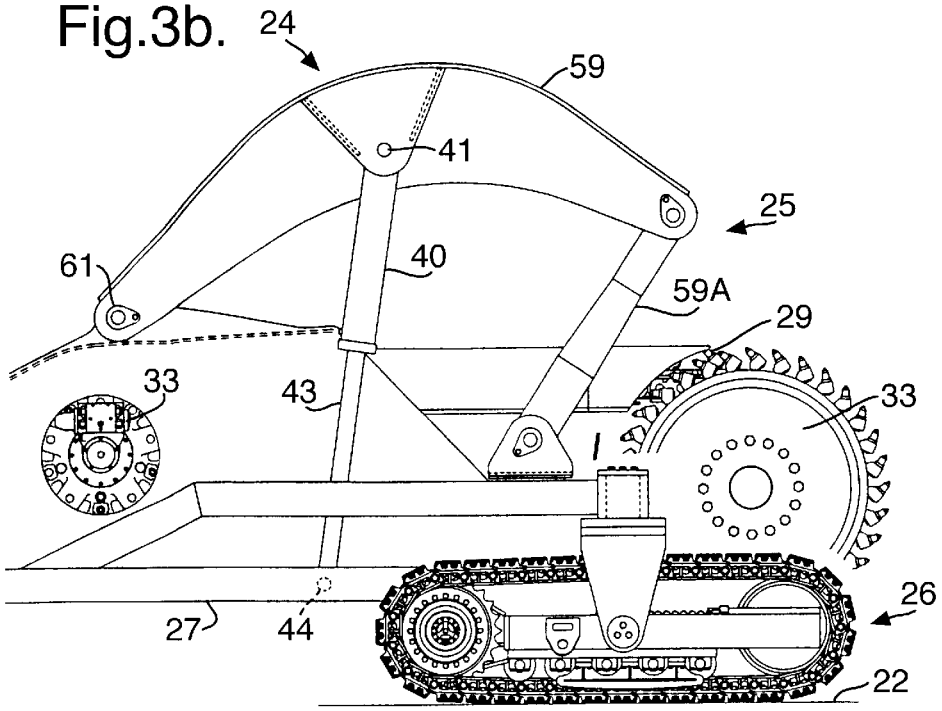
Figure 3C:
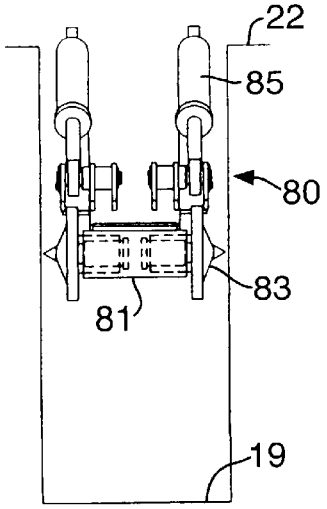
Figure 4:
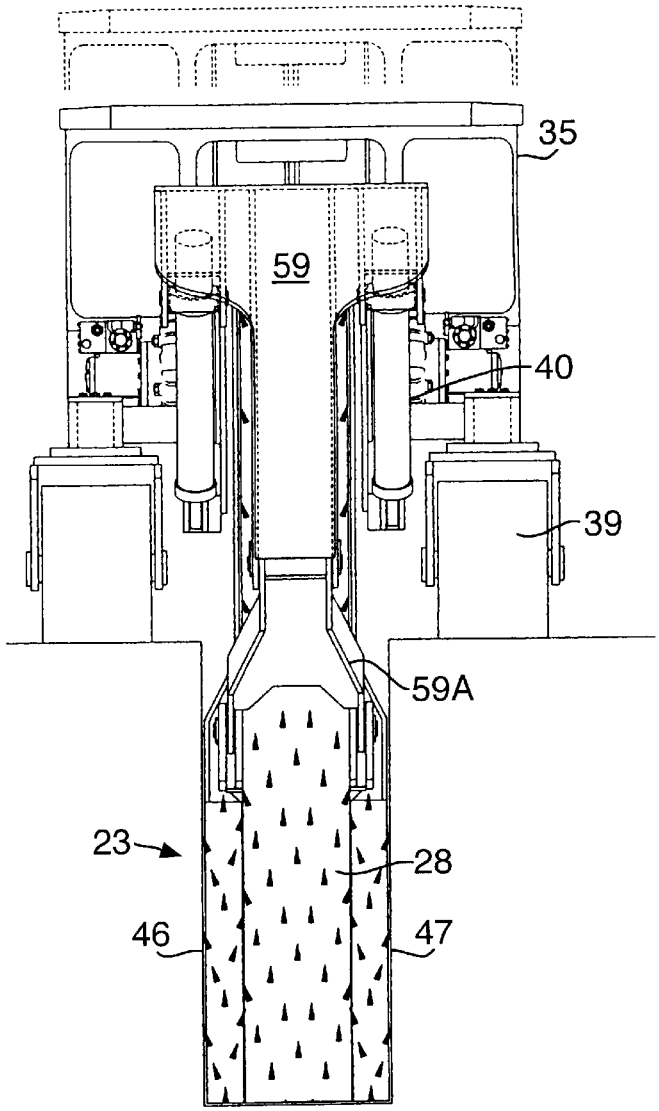
Figure 5:
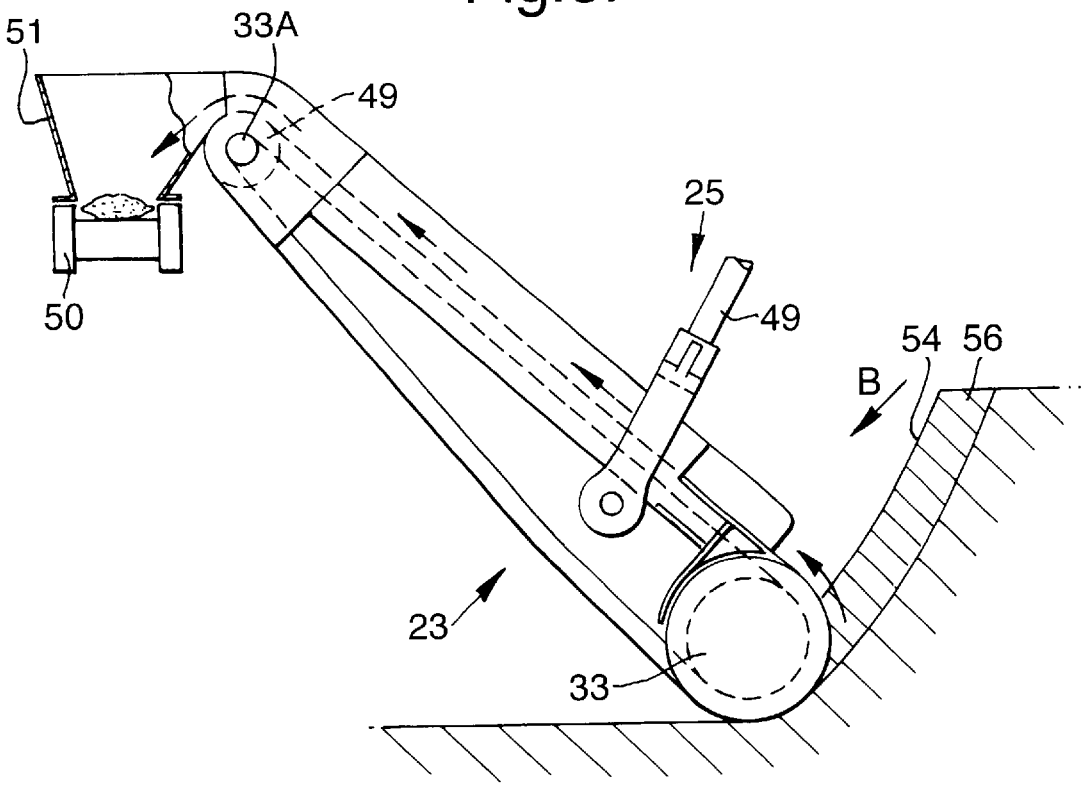
Figure 5A:
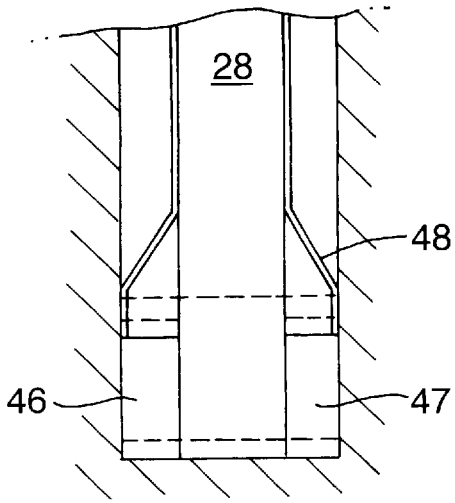
Figure 6A:
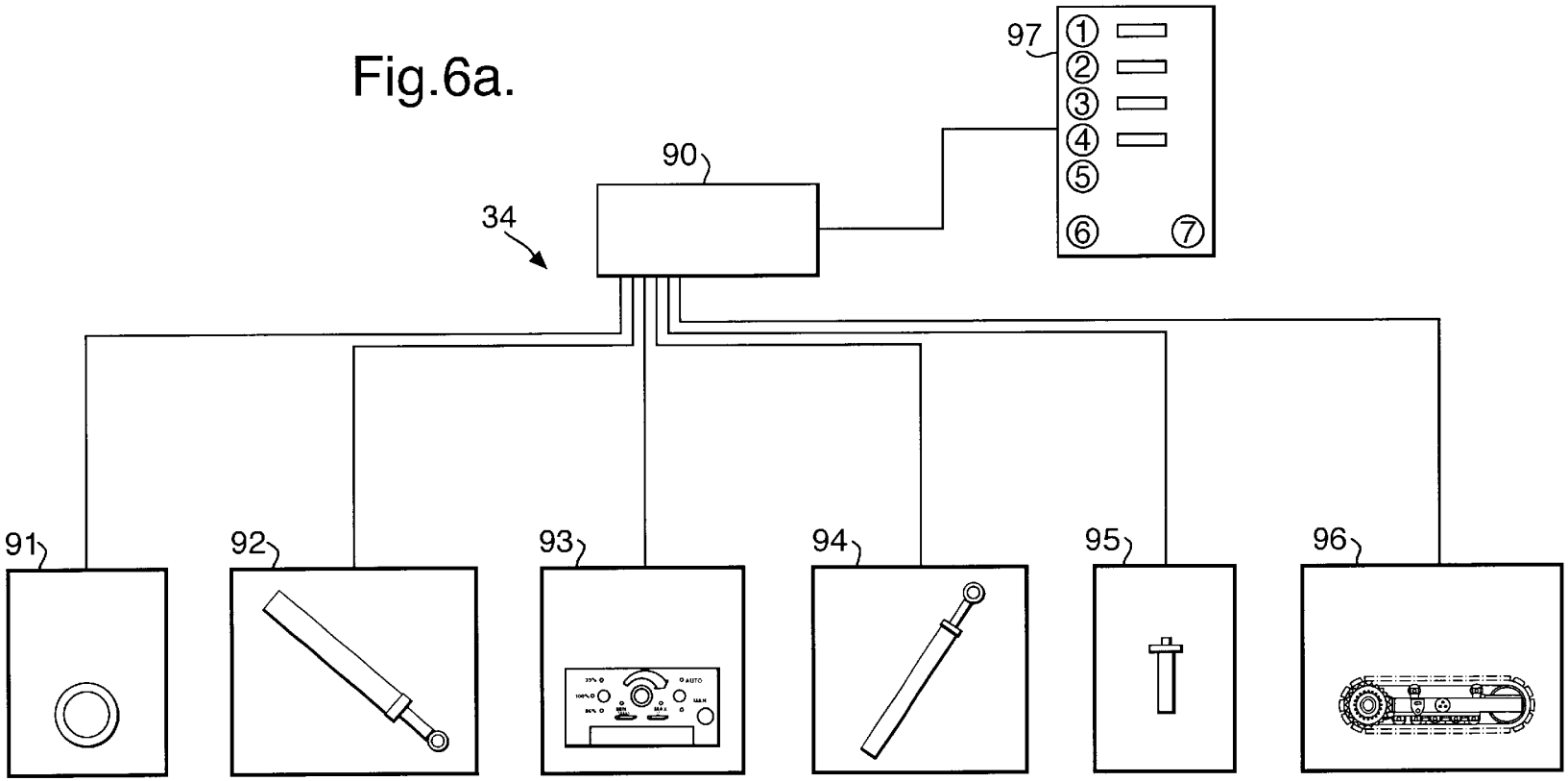
Figure 6B:
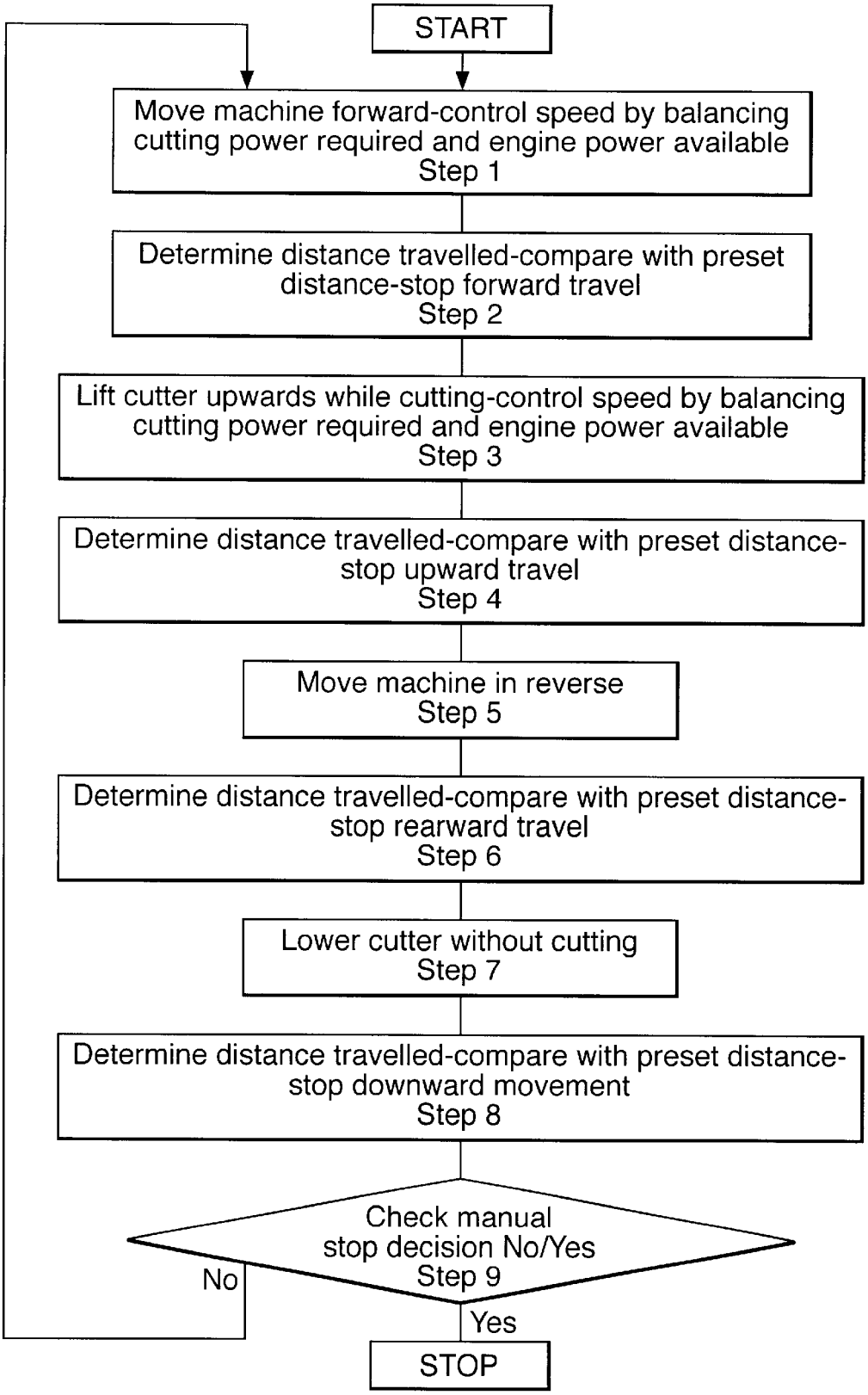
Figure 7A:
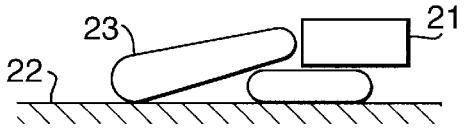
Figure 7B:
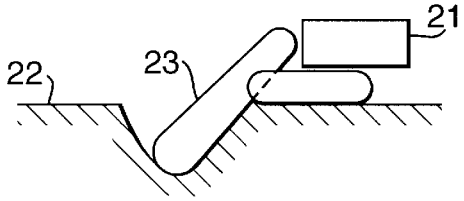
Figure 7C:
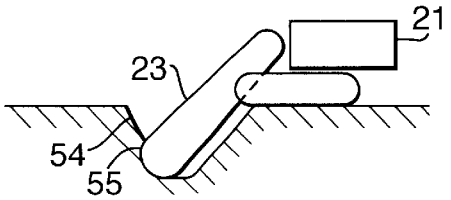
Figure 7D:
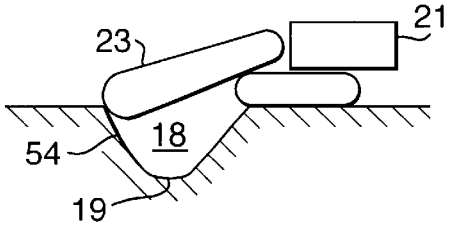
Figure 7E:
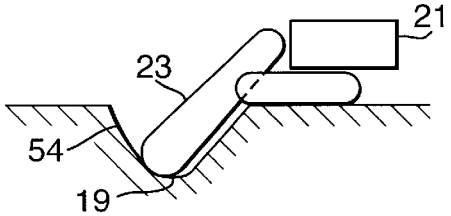
Figure 7F:
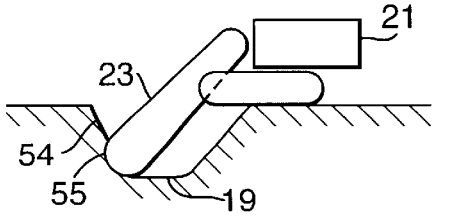
Figure 7G:
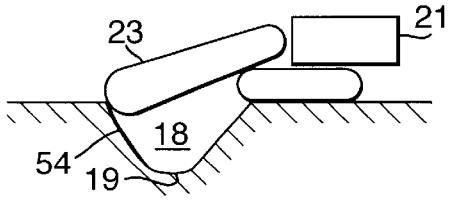
Figure 8:
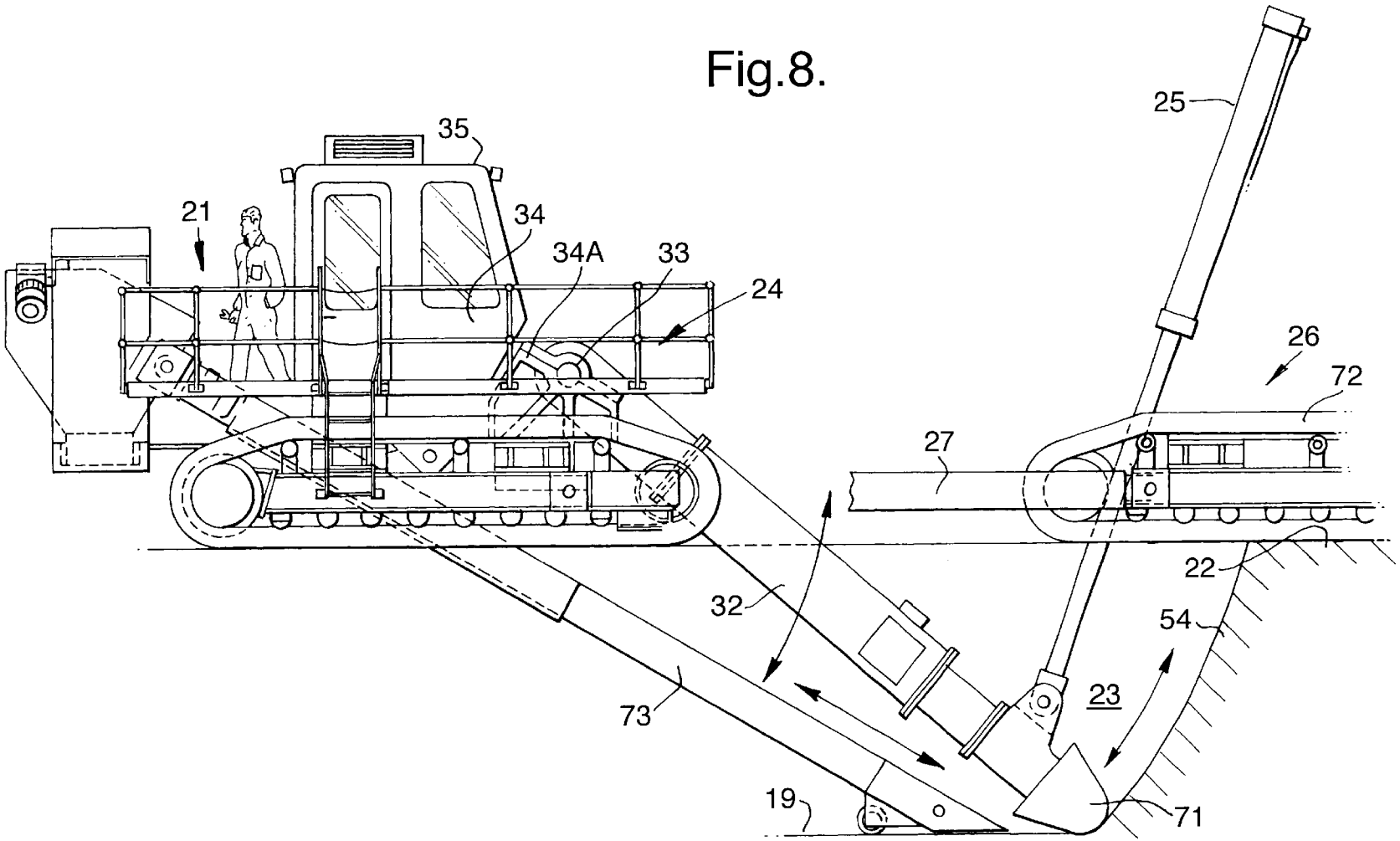

FIG. 3*a* is a side view of the distal end of a chain cutter suitable for use in the embodiment of FIG. 3, there being omitted for clarity a side cutting wheel shown in FIG. 3;

FIG. 3*b* shows the forward end of the apparatus of FIG. 3, at a different stage of operation, with a cutting boom raised, FIG. 3*c* is a view from the rear of a side clamp assembly of the apparatus of FIG. 3, taken in the direction C in FIG. 3;

FIG. 4 is a diagrammatic end view of the front of the apparatus shown in FIG. 3, taken in the direction A In FIG. 3;

FIG. 5 is a diagrammatic side view of details of the chain cutter shown in FIG. 3, and FIG. 5*a* is a partial plan view taken in a direction B in FIG. 5 and illustrating the lower end of the chain cutter of FIG. 5;

FIG. 6*a* is a block circuit diagram of the control means programmed to carry out a predetermined operating cycle of the apparatus, and FIG. 6*b* is a flow chart of the operating cycle;

FIGS. 7*a* to 7*g* are diagrammatic illustrations showing a series of steps in the operation of an embodiment of the invention shown in FIGS. 3 to 6; and FIG. 8 shows a diagrammatic side view of a yet further alternative embodiment of the invention, in which the cutting device comprises a milling cutter.

Figures 1, 2:
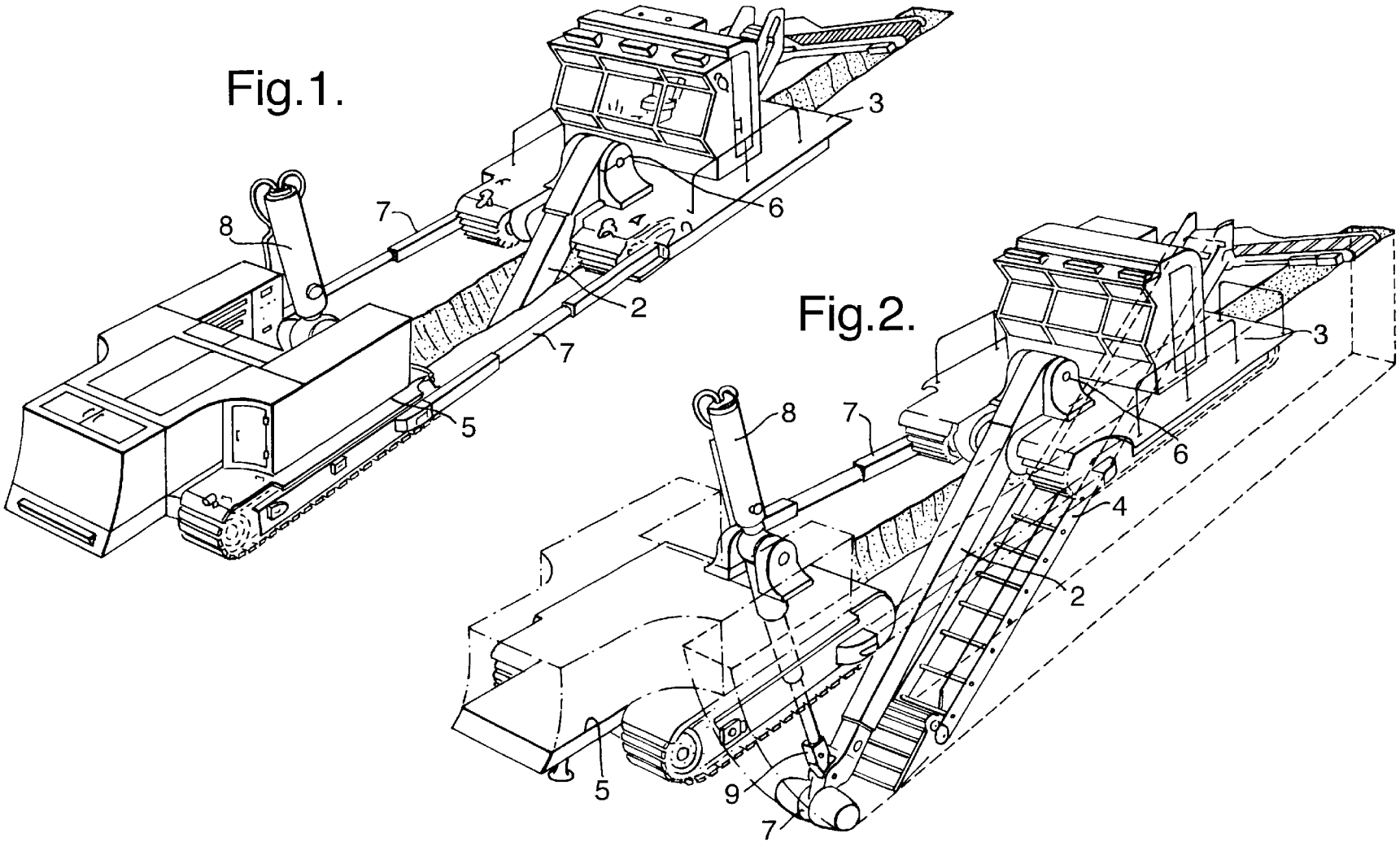
FIGS. 1 and 2 show perspective views of a known trench cutting apparatus described in EP-A-0080802, FIG. 2 showing details of the cutting device of the apparatus.

FIGS. 1 and 2 show a known trench cutting apparatus described in EP-A-0080802 for cutting a trench in rock. Two crawler chassis 3 and 5 arc coupled together by tie bare 7, the rear crawler 3 having a cutting boom 2 pivotally mounted at 6. The forward end of the boom 2 has a cutting rotor 7 driven in rotation about an axis transverse to the trench to be cut. The distal end of the boom 2 is coupled To the forward crawler 5 by a telescopic control arm 8 comprising an hydraulic ram and telescopically extending sleeves coupled to the boom 2 by a coupling 9. In operation the machine is positioned to straddle the line of the trench and the boom 2 is lowered into contact with the ground. The cutting head 7 is rotated while applying force by way of the hydraulic ram 8 to move the cutting head 7 on an arcuate path downwardly and to remove rock from the Forward end of the trench. An endless chain conveyor 4 is positioned behind the cutting rotor 7 and the spoil is carried away. The boom 2 is then raised and the machine moved forward and the process is repeated.

In such a machine, the disadvantage arises that the force applied to the cutting head 7 Tends to lift the forward crawler 5 out of contact with the ground. To attempt to counteract this problem, first the hydraulic ram 8 is mounted on a heavy, Independent, crawler chassis 5, and secondly additional ballast may be carried by either or both of the forward and rearward crawlers 5 and 3.

In FIGS. 3 to 4 there is shown a trench cutting apparatus embodying the present invention. In general, components of the embodiment of the invention which are known in the art, may be as set out in the previously mentioned specification EP-A-0080802, modified as necessary in the light of the features of the invention embodied In the apparatus shown. Referring firstly to FIG. 3, trenching apparatus for cutting a trench in rock or the like has a first prime mover 21 having a cab 35, and a movable base unit 26 consisting of a second prime mover without a cab. Each prime mover consists of a crawler chassis for movement over the ground surface 22. A cutting device indicated generally at 23 is mounted on the prime mover 21 by mounting means indicated generally at 24. A lifting means indicated generally at 25 is coupled to the cutting device 23 in the region of the distal end thereof. The mobile base unit 26 is coupled to the first prime mover 21 by a framework 27. The entire operation of the machine is controlled by control means indicated diagrammatically at 34, located in a cab 35 of the prime mover 21.

Considering now the detailed construction of the embodiment shown in FIG. 3, the cutting device 23 consists of an endless chain cutter comprising an elongate endless support means 28 such as a chain, carrying cutting teeth 29, indicated in more detail in FIG. 3*a*. The chain 28 is trained along upper and lower runs 30 and 31 on a boom 32. The cutting teeth 29 pass at the end of the boom 32 around a pulley 33. The elements 29 are driven by an upper pulley 49, in a sense such that at the distal end of the boom 32 the cutting elements move upwardly around the distal end of the boom and rearwardly along the upper run 30, relative to the intended direction of forward movement of the prime mover 21, which is indicated by the direction X in FIG. 3. FIG. 3*a* shows the distal end of the boom 32 and details of the mounting of the teeth 29 on the endless support means 28. The chain cutter 23 is driven by drive means including for example an hydraulic drive motor mounted in or on the prime mover 21, and the upper driven pulley 49. In general the cutting device 23 may be a chain cutter as shown in prior publication patent application WO 96/13433, although the chain cutter in that publication is driven in movement in the opposite sense to that shown in the present embodiment, so that the directional alignment of the teeth is reversed in the prior publication mentioned.

In the embodiment shown in FIG. 3, the mounting means 24 for mounting the boom 32 on the prime mover 21 comprise a pivot shaft 33A mounted between two mounting members mounted on the main frame of the prime mover 21. The lifting means 25 includes a pivoted arm 59 pivoted to the prime mover 21 at a pivot 61 and extending forwardly thereof. A pivoted link 59A is coupled at one end to a forward end of the pivoted arm 59 and at the other end to the beam 32 of the cutting device 23. A source of lifting power consisting of an hydraulic ram 40 is coupled between the arm 59 and the framework 27. The ram 40 is coupled to the arm 59 at a position intermediate the two ends thereof, and to the framework 27 at a position intermediate the two ends thereof. A drive piston 43 (FIG. 3*b*) extends downwardly from the ram 40 and is coupled at the pivot 44 to the framework 27. The cutting device 23 is shown in full lines in a lower position at the base of the trench (in FIG. 3), and in broken lines in a raised position (in FIG. 3*b*).

In FIGS. 3 and 3*c* there is shown an additional, optional, assembly of components for stabilising the pivoting of the main cutting boom 32. Attached to the cutting boom 32 is a side clamping assembly indicated generally at 80. The main component is a transverse hydraulic ram Indicated generally at 81, extending across the trench perpendicular to the direction of travel of the prime mover 21. At each end of the hydraulic ram 81 is a circular pressure plate 83 which bears against the inner side of the trench. During the lifting stage of the cutting cycle, the hydraulic ram 81 is expanded, and the clamping plates 83 are pressed outwardly against the sides of the trench.

The clamping plates 83 are coupled to the boom 32 by a second clamp ram 85 and a strut comprising a ram 84. The strut 84 is pivotally connected between the first clamp ram 81 and a pivot point 86 on the boom 32. The second clamp ram 85 is pivotally coupled between a pivot point 57 intermediate the ends of the strut 84, and a pivot 88 on the boom 32. During the powered up stroke of the main ram 40, the clamp ram 84 is expanded, to stabilise the movement, and to assist the upward cutting arc. It will be appreciated that while the main ram 40 exerts a force upwardly between the boom 32 and ground level 22, the clamp ram 84 exerts an upward force on the boom 32 acting between the boom 32 and the stationary position of the side clamping plates 83, which are held in place by the expanded ram 81.

As shown in FIG. 4, conveniently the cutting device 23 has in addition to the cutting chain 28, extension drums 46 and 47 extending sideways from the pulley 33 at the distal end of the cutting boom, so as to widen the channel cut by the cutting means. The extension drums are removable and interchangeable to allow the width of the trench to be varied by using drums of different widths. FIG. 5*a* shows a detailed view of the cutting device 23. There is positioned behind the distal end of the boom 32 a deflector plate assembly 48 for collecting debris cut by the cutting chain 28 and the extension drums 46, 47. The deflector plate assembly 48 guides the debris inwardly towards a central area where the debris is carried upwardly and rearwardly by the chain cutter 23. As shown in FIGS. 5 and 5*a*, at the top of the cutting boom 32, the chain cutter 23 passes around the upper pulley 49 and deposits the debris onto a side discharge conveyor 50, by way of a boom discharge hopper 51.

The operation of the embodiment will now be described particularly with reference to FIGS. 7*a* to 7*g*, but also with reference to FIGS. 3 to 5*b*. FIGS. 7*a* to 7*g* show diagrammatic representations of the different stages in the cycles of operation. FIGS. 7*a* and 7*b* show an initial stage of starting tho trench. This may be done as shown, or alternatively may be cut by hand, explosives, percussion tools, or any other means. However referring to FIGS. 7*a* and 7*b*, initially the cutting device 23 is lowered to tho ground level 22, and the cutting device is operated while being forced downwardly. This may conveniently be done by operating in reverse the lifting device 25 which has been described with reference to FIGS. 3 to 5*a*. As shown in FIG. 7*b*, the result is the cutting of the beginning of a trench with an arcuate end fare 54. During the step shown in FIGS. 7*a* and 7*b*, the cutting device 23 is operated in the manner set out in the known machine of EP-A-0080802, i.e. cutting on the down stroke. Alternately a starting hole can be provided by other conventional means such as drilling or blasting, or by a rock hammer.

As shown in FIG. 7*c*, the next step is that the cutting device 23 is operated whilst the prime mover 21 is driven forwardly, so as to produce an undercut 55 in the end face 54 of the trench. The next step is that the lifting means 25 as shown for example in FIG. 3 is operated to pivot the cutting device 23 upwardly from the undercut 55, while the cutting device 23 is operating, so as to cut material from the end face of the trench 54. This cutting operation is shown in detail in FIG. 5, where there is shown the material 56 which is cut from the end face 54 during upward movement of the cutting device 23 by the lifting means 25. This produces the new end face 54 of the trench as shown in FIG. 7*d*. When this is completed the cutting device 23 is lowered to the bottom 19 of the trench 18 as shown in FIG. 7*e*. The process is then repeated by operating the cutting device and moving the prime mover forwardly as shown in FIG. 7*f* to produce a new undercut 55. Finally the cutting device 23 is again raised upwardly from the undercut 55 to cut a new end face 54 as shown in FIG. 7*g*.

The main advantage of the embodiment of the invention which has been described is that during the upward cutting stroke of the cutting device 23 the force exerted between the cutting device 23 and the ground surface 22, by way of the mobile base 26, is limited only by the force generated by the lifting means 25 and is not limited by the potential floating of the base 25 up from the ground, as in the device shown in FIGS. 1 and 2 (where cutting is effected on the down stroke of the cutting device). It is not necessary to provide substantial weight in the part of the apparatus on which the lifting means is mounted, as would be the case if the lifting means were pressing downwardly on the cutting device during the cutting stroke.

Additional advantages arise in connection with the cutting of the undercut 55. Because the cutting area at the distal end of the cutting device 23 is relatively limited, and because the prime mover 21 is moving forwardly during the cutting of the undercut, the problem of penetration effort into hard rock is substantially reduced, compared with the difficulty of penetrating from above during a downward cutting stroke. The advantage arises because the number of cutting tools or teeth which are in contact with the hard rock is limited to those at the distal end of the beam. In the known arrangement of EP-A-0080802 the whole cutting face of the chain cutter would be in contact with the rock to be cut. In the embodiment of the present invention the power available can be concentrated in few working tools, resulting in the application of more power per tool.

Referring now to FIGS. 6*a* and 6*b* there will be described the block circuit diagram of FIG. 6*a*, and the flow diagram of FIG. 6*b*. In FIG. 6*a*, the control means 34 is shown as consisting of a microprocessor 90 receiving information from a series of sensors, indicated diagrammatically as a clamp sensor 91 (for sensing when vie clamp assembly 80 is fixed in position against the side walls of the trench); a clamp travel sensor 92 (for sensing the degree of travel of the clamp rams 81 and 85); an engine load control sensor 93 (for sensing the load placed on the engine at various stages of the cycles); a cutting depth sensor 94 (for sensing the depth of cutting of the cutting means 23); a cutting depth reference sensor 95 (for sensing the maximum depth of cutting of the apparatus in relation to a required reference plane); and a forward/reverse movement sensor 96 (for detecting direction of movement of the two crawler chassis of the prime movers 21 and 26). The microprocessor is also linked to an operator control unit 97 which allows the operator to set requirements for seven functions of the apparatus, for example seven functions as follows:

1. Forward movement.
2. Reverse movement.
3. Max cutting depth.
4. Min cutting depth.
5. Trench clamp on/off.
6. System on/off.
7. Manual/automatic.

The operation of the apparatus in a predetermined automatic operating cycle. Incorporates the program flow chart of FIG. 6*b*, and operates in normal use as follows. First the machine is maneuvered manually into position. Then, in order to cut a first part of the trench in the virgin rock, the cutting boom 32 is lowered into the surface while cutting to the required depth, which is determined either manually or from a reference signal provided, for example by a laser, as in prior published Patent Application No. WO95/13433. Automatic operation is then selected. In steps 1 and 2, the apparatus moves forward a preset distance. The speed of forward movement is automatically controlled and balanced by the load control between cutting power required and engine power available, to ensure maximum performance. When the preset distance has been achieved, the forward movement will stop and a signal will automatically be sent to the lift cylinder 40. In steps 3 and 4, the lift cylinder 40 will push the cutting apparatus upwards while cutting the front surface of the trench. The speed of the upward movement will automatically be controlled by the load control, and will balance out the cutting power required and the engine power available until the cutting apparatus reaches a preset distance (the minimum cutting depth, set with reference to the reference plane). In steps 5 and 6, the machine is moved in reverse for a preset distance. Thereafter in steps 7 and 8 the lift cylinder 40 will lower the cutting apparatus down TO the previous preset depth. If the operator then wishes to stop a manual stop decision will be entered at step 9. If not, the cycle will be repeated from step 1 onwards.

For enhanced stability whilst cutting into tho face of the trench, the clamping assembly 80 is added, which clamps between the side faces of the trench. The control means 34 can be expanded so as to control also the operation of the clamping assembly. This will release and retract during lowering of the cutting boom and reverse movement of the machine, but will clamp and assist during the forward movement and the upward cutting of the cutting mechanism. This will also operate automatically within the operating sequence of the machine. The steering of the machine can either be done manually or automatically by signals from, for example, a preset wire line, or laser. The verticality of the trench can be adjusted by a side tilt system built into the machine track frames.

There will now be described with reference to FIG. 8 an alternative embodiment of the present invention, in which the chain cutter of FIGS. 1 to 6 is replaced by a milling cutter comprising X cutting rotor mounted on the distal end of the cutting boom, and driven in rotation about an axis aligned generally along the direction of the length of the boom. Components which correspond to components previously described are indicated by like reference numerals. In the embodiment of FIG. 8, the cutting device 23 comprises a cutting boom 32 having a milling cutter 71 mounted at the distal end thereof. Mounted behind the milling cutter 71 is an endless conveyor belt 73 for removing the debris cut by the milling cutter 71. In the embodiment shown, the mobile base 26 of the apparatus runs on tracks 72. The general construction and operation of the milling cutter 71 and debris removing conveyor 73 are as set out in the prior specification EP-A-0080802. The general construction and operation of the lifting means 25 of FIG. 8, and of the overall operation of the trenching apparatus, is as has been described with reference to FIGS. 3 to 7 of the present application. In other arrangements, the conveyor 73 of the embodiment of FIG. 8 may be used together with the chain cutter of FIGS. 3 to 5*b*.

In addition to the inventive features set out in general in the introduction of the specification, it may also be provided in a preferred aspect of the invention that the method of trenching includes stabilising the upward cutting movement of the cutting device by engaging the sides of the trench by side components of the apparatus and exerting an upward force on the cutting device acting between the side components and the cutting device during the upward cutting movement of the cutting device. Preferably the method includes pressing the side components outwardly against the sides of the trench during the upward cutting movement of the cutting device.

It may also be provided In a preferred aspect of the invention that the trenching apparatus according to the invention includes a stabilising assembly extending rearwardly from the cutting device for stabilising the upward cutting movement of the cutting device, the stabilising assembly comprising side components adapted to engage the sides of the trench during the upward cutting movement of the cutting device, and a powered linkage coupling the side components to the cutting device and arranged to exert an upward force on the cutting device acting between the side components and the cutting device during the upward movement of the cutting devise. Preferably the stabilising assembly includes a powered transverse component extending between the side components and arranged to press the side components outwardly against the sides of the trench during the upward cutting movement of the cutting device.

What is claimed is:

1. A method of trenching comprising:

positioning in a trench a cutting device mounted on a prime mover movable on the ground surface above the trench;

engaging an end face of the trench with the cutting device below the level of the ground surface;

moving the cutting device forward in the trench while operating the cutting device, so as to produce an undercut in the end face of the trench;

producing the undercut by driving the prime mover forwardly over the ground surface while operating the cutting device;

cutting material from the end face of the trench by moving a plurality of cutting elements along upper and lower runs of an elongate endless support trained along a pivoted boom which projects forwardly and downwardly relative to the intended direction of cutting the trench, the cutting elements being driven in such a manner that at the distal end of the cutting boom the elements move in a direction upwardly around the end of the cutting boom and rearwardly along the upper run relative to the direction of cutting the trench;

cutting the trench wider than the endless support by further cutting elements of the cutting device; and lifting the boom upwardly from the undercut up to the top of the trench by exerting a lifting force between the boom and the ground surface above the trench and operating the cutting device during the upward movement so as to cut material from the end face of the trench.

2. A method according to claim 1 including:

cutting the trench wider than the endless support by operation of a pair of cutting drums extending sideways from the distal end of the cutting boom.

3. A method according to claim 1 including applying the said lifting force to the cutting boom below ground level.

4. A method according to claim 3 including applying the said lifting force at the sides of the cutting boom.

5. A method according to claim 3 including exerting a lifting force on the cutting device in the region of the distal end of the boom.

6. A method according to claim 1 in which the said lifting step is carried out by pivoting the cutting boom about a pivot axis on the prime mover, and the said undercut is produced by driving the prime mover forwardly over the ground by driving contact with the ground surface at a position behind the boom pivot axis.

7. A method according to claim 1 having a predetermined operating cycle comprising:

(i) positioning the cutting device against the end face of the trench at the bottom of the trench;

(ii) moving the cutting device forwardly a predetermined distance in the trench while operating the cutting device so as to produce the undercut in the end face of the trench, by moving the prime mover forwardly over the ground surface;

(iii) lifting the cutting device upwardly from the undercut through the material of the end face while operating the cutting device;

(iv) moving the cutting device rearwardly by a predetermined distance by moving the prime mover rearwardly over the ground surface;

(v) lowering the cutting device to the bottom of the trench; and (vi) repeating the previous steps.

8. A method according to claim 1 including engaging the sides of the trench by side components of the apparatus; and exerting on the boom a further upward force acting between the side components and the boom during the upward cutting movement of the cutting device while the side components are engaged with the sides of the trench at a stationary position.

9. A method according to claim 8 including pressing the side components outwardly against the sides of the trench at the stationary position during the upward cutting movement of the cutting device.

10. A method according to claim 8 having a predetermined operating cycle comprising:

(i) positioning the cutting device against the end face of the trench at the bottom of the trench;

(ii) moving the cutting device (23) forwardly a predetermined distance in the trench while operating the cutting device (23) so as to produce the undercut in the end face of the trench, by moving the prime mover (21) forwardly over the ground surface (22);

(iii) pressing the side components (83) outwardly against the sides of the trench at a stationary position with the cutting device (23) positioned against the end face (54) of the trench;

(iv) lifting the cutting device (23) upwardly from the undercut through the material (56) of the end face while operating the cutting device (23);

(v) releasing and retracting the side components from the sides of the trench;

(vi) moving the cutting device (23) rearwardly by a predetermined distance by moving the prime mover (21) rearwardly over the ground surface (22);

(vii) lowering the cutting device (23); and (viii) repeating the previous steps.

11. Trenching apparatus comprising:

a prime mover;

a cutting device;

mounting structure constructed and arranged to mount the cutting device on the prime mover and to position the cutting device in a trench with the prime mover movable on the ground surface above the level of the trench, said cutting device comprising a boom having an elongate endless support carrying a plurality of cutting elements and trained along upper and lower runs on the boom, the boom being mounted to project forwardly and downwardly relative to the intended direction of cutting the trench;

a drive unit constructed and arranged to drive the endless support in a direction such as to carry the cutting elements upwardly around the distal end of the boom and rearwardly along the upper run of the endless support; and a lifting device constructed and arranged to lift the boom from an undercut in an end face at the bottom of the trench upwardly to the top of the trench while operating the cutting device in cutting engagement with the end face of the trench so as to cut material from the end face of the trench, the lifting device being constructed and arranged to exert an upward force between the boom and the ground surface above the trench;

the cutting boom being mounted on the prime mover for pivotal movement about a pivot axis to produce the said upward movement of the cutting device, and the prime mover being adapted to produce the said undercut at the bottom of the trench by driving the prime mover forwardly over the ground by driving contact with the ground surface at a position behind the boom pivot axis; and the cutting device including further cutting elements constructed and arranged to widen the channel cut by the said cutting elements on the endless support.

12. Apparatus according to claim 11 in which the said further cutting elements are mounted on cutting drums extending sideways from the distal end of the cutting boom.

13. Apparatus according to claim 11 in which the lifting device is coupled to the boom at a position such as to apply the said lifting force to the cutting boom below ground level during normal operation.

14. Apparatus according to claim 13 in which the lifting device is coupled to the boom at the sides of the boom by a pivoted link.

15. Apparatus according to claim 13 which the said lifting device is coupled to the boom in the region of the distal end of the boom.

16. Apparatus according to claim 11 in which cutting boom is mounted on the prime mover for pivotal movement about a pivot axis to produce the said upward movement of the cutting device, and the prime mover is adapted to produce the said undercut at the bottom of the trench by driving the prime mover forwardly over the ground by driving contact with the ground surface at a position behind the boom pivot axis.

17. Apparatus according to claim 16 in which the prime mover includes a rearward crawler chassis positioned to the rear of the boom pivot axis.

18. Apparatus according to claim 17 including a mobile base spaced forwardly from the boom pivot axis and coupled thereto for movement therewith.

19. Apparatus according to claim 11 including control means programmed to carry out a predetermined operating cycle in which:

(i) the mounting structure positions the cutting device against the end face of the trench at the bottom of the trench;

(ii) the prime mover moves the cutting device forwardly a predetermined distance in the trench while operating the cutting device so as to produce an undercut in the end face of the trench, by moving the prime mover forwardly over the ground surface;

(iii) the lifting device lifts the cutting device upwardly from the undercut through the material of the end face while operating the cutting device;

(iv) the prime mover moves the cutting device rearwardly by a predetermined distance, by moving the prime mover rearwardly over the ground surface;

(v) the lifting device lowers the cutting device to the bottom of the trench; and (vi) the previous steps are repeated.

20. Apparatus according to claim 11 including:

side components adapted to engage the sides of the trench; and a powered linkage coupling the side components to the cutting device and arranged to exert a further upward force on the boom acting between the side components and the boom during the upward movement of the cutting device while the side components are engaged with the sides of the trench at a stationary position.

21. Apparatus according to claim 20 including a powered transverse component extending between the side components and arranged to press the side components outwardly against the sides of the trench during the upward cutting movement of the cutting device.

22. Apparatus according to claim 20 in which the said side components are positioned rearwardly from the cutting device.

23. Apparatus according to claim 20 including control means programmed to carry out a predetermined operating cycle in which:

(i) the mounting structure positions the cutting device against the end face of the trench at the bottom of the trench;

(ii) the prime mover moves the cutting device forwardly a predetermined distance in the trench while operating the cutting device, so as to produce the undercut in the end face of the trench, by moving the prime mover forwardly over the ground surface;

(iii) the powered transverse component presses the side components outwardly against the sides of the trench at a stationary position with the cutting device positioned against the end face of the trench;

(iv) the lifting means lifts the cutting device upwardly from the undercut through the material of the end face while operating the cutting device while the powered linkage exerts the further upward force on the cutting device;

(v) the powered transverse component releases and retracts the side components from the sides of the trench;

(vi) the prime mover moves the cutting device rearwardly by a predetermined distance by moving the prime mover rearwardly over the ground surface;

(vii) the lifting means lowers the cutting device to the bottom of the trench; and (viii) the previous steps are repeated.

24. A method of trenching comprising:

positioning in a trench a cutting device mounted on a prime mover movable on the ground surface above the trench;

engaging an end face of the trench with the cutting device below the level of the ground surface;

moving the cutting device forward in the trench while operating the cutting device, so as to produce an undercut in the end face of the trench;

cutting material from the end face of the trench by moving a plurality of cutting elements along upper and lower runs of an elongate endless support trained along a pivoted boom which projects forwardly and downwardly relative to the intended direction of cutting the trench, the cutting elements being driven in such a manner that at the distal end of the cutting boom the elements move in a direction upwardly around the end of the cutting boom and rearwardly along the upper run relative to the direction of cutting the trench; and lifting the boom upwardly from the undercut up to the top of the trench by exerting a lifting force between the boom and the ground surface above the trench and operating the cutting device during the upward movement so as to cut material from the end face of the trench.

25. A method according to claim 24 including cutting the trench wider than the endless support by further cutting elements of the cutting device.

26. A method according to claim 25 including:

cutting the trench wider than the endless support by operation of a pair of cutting drums extending sideways from the distal end of the cutting boom.

27. A method according to claim 25 including applying the said lifting force to the cutting boom below ground level.

28. A method according to claim 27 including applying the said lifting force at the sides of the cutting boom.

29. A method according to claim 24 in which the step of producing the said undercut is carried out by driving the prime mover forwardly over the ground surface while operating the cutting device.

30. A method according to claim 29 in which the said lifting step is carried out by pivoting the cutting boom about a pivot axis on the prime mover, and the said undercut is produced by driving the prime mover forwardly over the ground by driving contact with the ground surface at a position behind the boom pivot axis.

31. A method according to claim 30 in which the said undercut is produced by driving contact with the ground surface both at a position behind the boom pivot axis and at a position in front of the boom pivot axis.

32. A method according to claim 24 in the step of producing the undercut the cutting device is positioned to engage the end face substantially at the bottom of the trench.

33. A method according to claim 24 in which the said lifting step is carried out by moving the cutting device along an arcuate path defined by pivotal movement of the boom.

34. A method according to claim 24 including exerting a force between the cutting device and a region of the ground surface spaced from the axis of pivoting of the boom in a forward direction along the trench.

35. A method according claim 24 including exerting a force between the cutting device and the ground surface in a direction substantially perpendicular to the axis of the boom.

36. A method according to claim 24 including exerting a lifting force on the cutting device in the region of the distal end of the boom.

37. A method according to claim 24 including exerting a lifting force on the cutting device in a direction inclined to the vertical in a direction forwardly relative to the direction of cutting of the trench.

38. A method according to claim 26 having a predetermined operating cycle comprising:

(i) positioning the cutting device against the end face of the trench at the bottom of the trench;

(ii) moving the cutting device forwardly a predetermined distance in the trench while operating the cutting device so as to produce the undercut in the end face of the trench, by moving the prime mover forwardly over the ground surface;

(iii) lifting the cutting device upwardly from the undercut through the material of the end face while operating the cutting device;

(iv) moving the cutting device rearwardly by a predetermined distance by moving the prime mover rearwardly over the ground surface;

(v) lowering the cutting device to the bottom of the trench; and (vi) repeating the previous steps.

39. A method according to claim 24 including engaging the sides of the trench by side components of the apparatus; and exerting on the boom a further upward force acting between the side components and the boom during the upward cutting movement of the cutting device while the side components are engaged with the sides of the trench at a stationary position.

40. A method according to claim 39 having a predetermined operating cycle comprising:

(i) positioning the cutting device against the end face of the trench at the bottom of the trench;

(ii) moving the cutting device (23) forwardly a predetermined distance in the trench while operating the cutting device (23) so as to produce the undercut in the end face of the trench, by moving the prime mover (21) forwardly over the ground surface (22);

(iii) pressing the side components (83) outwardly against the sides of the trench at a stationary position with the cutting device (23) positioned against the end face (54) of the trench;

(iv) lifting the cutting device (23) upwardly from the undercut through the material (56) of the end face while operating the cutting device (23);

(v) releasing and retracting the side components from the sides of the trench;

(vi) moving the cutting device (23) rearwardly by a predetermined distance by moving the prime mover (21) rearwardly over the ground surface (22);

(vii) lowering the cutting device (23); and (viii) repeating the previous steps.

41. A method according to claim 24 including pressing the side components outwardly against the sides of the trench at the stationary position during the upward cutting movement of the cutting device.

42. Trenching apparatus comprising:

a prime mover;

a cutting device;

mounting structure constructed and arranged to mount the cutting device on the prime mover and to position the cutting device in a trench with the prime mover movable on the ground surface above the level of the trench, said cutting device comprising a boom having an elongate endless support carrying a plurality of cutting elements and trained along upper and lower runs on the boom, the boom being mounted to project forwardly and downwardly relative to the intended direction of cutting the trench, the cutting device including further cutting elements constructed and arranged to widen the channel cut by the said cutting elements on the endless support;

a drive unit constructed and arranged to drive the endless support in a direction such as to carry the cutting elements upwardly around the distal end of the boom and rearwardly along the upper run of the endless support; and a lifting device constructed and arranged to lift the boom from an undercut in an end face at the bottom of the trench upwardly to the top of the trench while operating the cutting device in cutting engagement with the end face of the trench so as to cut material from the end face of the trench, the lifting device being constructed and arranged to exert an upward force between the boom and the ground surface above the trench.

43. Apparatus according to claim 42 in which the said further cutting elements are mounted on cutting drums extending sideways from the distal end of the cutting boom.

44. Apparatus according to claim 42 in which the lifting device is coupled to the boom at a position such as to apply the said lifting force to the cutting boom below ground level during normal operation.

45. Apparatus according to claim 44 in which the lifting device is coupled to the boom at the sides of the boom by a pivoted link.

46. Apparatus according to claim 44 which the said lifting device is coupled to the boom in the region of the distal end of the boom.

47. Apparatus according to claim 42 in which cutting boom is mounted on the prime mover for pivotal movement about a pivot axis to produce the said upward movement of the cutting device, and the prime mover is adapted to produce the said undercut at the bottom of the trench by driving the prime mover forwardly over the ground by driving contact with the ground surface at a position behind the boom pivot axis.

48. Apparatus according to claim 47 in which the prime mover includes a rearward crawler chassis positioned to the rear of the boom pivot axis.

49. Apparatus according to claim 48 including a mobile base spaced forwardly from the boom pivot axis and coupled thereto for movement therewith.

50. Apparatus according to claim 49 in which the mobile base unit is coupled to the rearward crawler chassis by a framework, and the lifting device includes a pivoted arm pivoted to the framework and extending forwardly thereof, a pivoted link coupled at one end to a forward end of the pivoted arm and at the other end to the beam of the cutting device, and a source of lifting force coupled between the arm at a position intermediate the two ends thereof and the framework at a position intermediate the two ends thereof.

51. Apparatus according to claim 49 wherein the mobile base comprises a forward crawler chassis.

52. Apparatus according to claim 42 in which the lifting device is mounted so as to exert the lifting force in a direction inclined to the vertical in use in a direction forwardly relative to the direction of cutting of the trench.

53. Apparatus according to claim 42 in which the said lifting device is constructed and arranged to move the cutting device along an arcuate path defined by pivotal movement of the boom.

54. Apparatus according to claim 42 in which the lifting device is mounted so as to exert the lifting force between the cutting device and the ground surface in a direction substantially perpendicular to the axis of the boom.

55. Apparatus according to claim 42 which the lifting device includes an hydraulic ram.

56. Apparatus according to claim 42 including control means programmed to carry out a predetermined operating cycle in which:

(i) the mounting structure positions the cutting device against the end face of the trench at the bottom of the trench;

(ii) the prime mover moves the cutting device forwardly a predetermined distance in the trench while operating the cutting device so as to produce an undercut in the end face of the trench, by moving the prime mover forwardly over the ground surface;

(iii) the lifting device lifts the cutting device upwardly from the undercut through the material of the end face while operating the cutting device;

(iv) the prime mover moves the cutting device rearwardly by a predetermined distance, by moving the prime mover rearwardly over the ground surface;

(v) the lifting device lowers the cutting device to the bottom of the trench; and (vi) the previous steps are repeated.

57. Apparatus according to claim 42 including:

side components adapted to engage the sides of the trench; and a powered linkage coupling the side components to the cutting device and arranged to exert a further upward force on the cutting device acting between the side components and the cutting device during the upward movement of the cutting device while the side components are engaged with the sides of the trench at a stationary position.

58. Apparatus according to claim 57 including a powered transverse component extending between the side components and arranged to press the side components outwardly against the sides of the trench during the upward cutting movement of the cutting device.

59. Apparatus according to claim 57 in which the said side components are positioned rearwardly from the cutting device.

60. Apparatus according to claim 57 including control means programmed to carry out a predetermined operating cycle in which:

(i) the mounting structure positions the cutting device against the end face of the trench at the bottom of the trench;

(ii) the prime mover moves the cutting device forwardly a predetermined distance in the trench while operating the cutting device, so as to produce the undercut in the end face of the trench, by moving the prime mover forwardly over the ground surface;

(iii) the powered transverse component presses the side components outwardly against the sides of the trench at a stationary position with the cutting device positioned against the end face of the trench;

(iv) the lifting means lifts the cutting device upwardly from the undercut through the material of the end face while operating the cutting device while the powered linkage exerts the further upward force on the cutting device;

(v) the powered transverse component releases and retracts the side components from the sides of the trench;

(vi) the prime mover moves the cutting device rearwardly by a predetermined distance by moving the prime mover rearwardly over the ground surface;

(vii) the lifting means lowers the cutting device to the bottom of the trench; and (viii) the previous steps are repeated.

61. A method of trenching comprising:

positioning in a trench a cutting device mounted on a prime mover movable on the ground surface above the trench, the cutting device including a pivoted boom projecting forwardly and downwardly relative to the intended direction of cutting the trench;

engaging an end face of the trench with the cutting device below the level of the ground surface;

moving the cutting device forward in the trench while operating the cutting device, so as to produce an undercut in the end face of the trench; and lifting the boom upwardly from the undercut up to the top of the trench by exerting a lifting force between the boom and the ground surface above the trench and operating the cutting device during the upward movement so as to cut material from the end face of the trench;

the method further including:

engaging the sides of the trench by side components of the apparatus;

exerting on the boom a further upward force acting between the side components and the cutting device during the upward cutting movement of the cutting device while the side components are engaged with the sides of the trench at a stationary position.

62. A method according to claim 61 including pressing the side components outwardly against the sides of the trench at the stationary position during the upward cutting movement of the cutting device.

63. A method according to claim 61 having a predetermined operating cycle comprising:

(i) positioning the cutting device against the end face of the trench at the bottom of the trench;

(ii) moving the cutting device forwardly a predetermined distance in the trench while operating the cutting device so as to produce the undercut in the end face of the trench, by moving the prime mover forwardly over the ground surface;

(iii) pressing the side components outwardly against the sides of the trench at a stationary position with the cutting device positioned against the end face of the trench;

(iv) lifting the cutting device upwardly from the undercut through the material of the end face while operating the cutting device;

(v) releasing and retracting the side components from the sides of the trench;

(vi) moving the cutting device rearwardly by a predetermined distance by moving the prime mover rearwardly over the ground surface;

(vii) lowering the cutting device; and (viii) repeating the previous steps.

64. Trenching apparatus comprising:

a prime mover;

a cutting device;

mounting structure constructed and arranged to mount the cutting device on the prime mover and to position the cutting device in a trench with the prime mover movable on the ground surface above the level of the trench, the cutting device including a pivoted boom projecting forwardly and downwardly relative to the intended direction of cutting the trench, a lifting device constructed and arranged to lift the boom from an undercut in an end face at the bottom of the trench upwardly to the top of the trench while operating the cutting device in cutting engagement with the end face of the trench so as to cut material from the end face of the trench, the lifting device being constructed and arranged to exert an upward force between the boom and the ground surface above the trench' side components adapted to engage the sides of the trench; and a powered linkage coupling the side components to the boom and arranged to exert a further upward force on the cutting device acting between the side components and the cutting device during the upward movement of the boom while the side components are engaged with the sides of the trench at a stationary position.

65. Apparatus according to claim 64 including a powered transverse component extending between the side components and arranged to press the side components outwardly against the sides of the trench during the upward cutting movement of the cutting device.

66. Apparatus according to claim 64 in which the said side components are positioned rearwardly from the cutting device.

67. Apparatus according to claim 64 including control means programmed to carry out a predetermined operating cycle in which:

(i) the mounting structure positions the cutting device against the end face of the trench at the bottom of the trench;

(ii) the prime mover moves the cutting device forwardly a predetermined distance in the trench while operating the cutting device, so as to produce the undercut in the end face of the trench, by moving the prime mover forwardly over the ground surface;

(iii) the powered transverse component presses the side components outwardly against the sides of the trench at a stationary position with the cutting device positioned against the end face of the trench;

(iv) the lifting means lifts the cutting device upwardly from the undercut through the material of the end face while operating the cutting device while the powered linkage exerts the further upward force on the cutting device;

(v) the powered transverse component releases and retracts the side components from the sides of the trench;

(vi) the prime mover moves the cutting device rearwardly by a predetermined distance by moving the prime mover rearwardly over the ground surface;

(vii) the lifting means lowers the cutting device to the bottom of the trench; and (viii) the previous steps are repeated.

68. Trenching apparatus comprising:

a prime mover;

a cutting device;

mounting structure constructed and arranged to mount the cutting device on the prime mover and to position the cutting device in a trench with the prime mover movable on the ground surface above the level of the trench, said cutting device comprising a boom having an elongate endless support carrying a plurality of cutting elements and trained along upper and lower runs on the boom, the boom being mounted to project forwardly and downwardly relative to the intended direction of cutting the trench;

a drive unit constructed and arranged to drive the endless support in a direction such as to carry the cutting elements upwardly around the distal end of the boom and rearwardly along the upper run of the endless support; and a lifting device constructed and arranged to lift the boom from an undercut in an end face at the bottom of the trench upwardly to the top of the trench while operating the cutting device in cutting engagement with the end face of the trench so as to cut material from the end face of the trench, the lifting device being constructed and arranged to exert an upward force between the boom and the ground surface above the trench;

the boom being mounted on the prime mover for pivotal movement about a pivot axis to produce the said upward movement of the boom, and the prime mover being constructed and arranged to produce the said undercut at the bottom of the trench by driving the prime mover forwardly over the ground by driving contact with the ground surface at a position behind the boom pivot axis.

69. Apparatus according to claim 68 in which the lifting device is coupled to the boom at a position such as to apply the said lifting force to the boom below ground level during normal operation.

70. Apparatus according to claim 69 in which the lifting device is coupled to the boom at the sides of the boom by a pivoted link.

71. Apparatus according to claim 69 in which the said lifting device is coupled to the boom in the region of the distal end of the boom.

72. Apparatus according to claim 68 in which the lifting device is mounted so as to exert the lifting force in a direction inclined to the vertical in use in a direction forwardly relative to the direction of cutting of the trench.

73. Apparatus according to claim 68 in which the said lifting device is constructed and arranged to move the cutting device along an arcuate path defined by pivotal movement of the boom.

74. Apparatus according to claim 68 in which the lifting device is mounted so as to exert the lifting force between the cutting device and the ground surface in a direction substantially perpendicular to the axis of the boom.

75. Apparatus according to claim 68 in which the prime mover includes a rearward crawler chassis positioned to the rear of the boom pivot axis.

76. Apparatus according to claim 75 including a mobile base spaced forwardly from the boom pivot axis and coupled thereto for movement therewith.

77. Apparatus according to claim 76 in which the mobile base unit is coupled to the rearward crawler chassis by a framework, and the lifting device includes a pivoted arm pivoted to the framework and extending forwardly thereof, a pivoted link coupled at one end to a forward end of the pivoted arm and at the other end to the beam of the cutting device, and a source of lifting force coupled between the arm at a position intermediate the two ends thereof and the framework at a position intermediate the two ends thereof.

78. Apparatus according to claim 76 wherein the mobile base comprises a forward crawler chassis.

79. Apparatus according to claim 68 in which the lifting device includes an hydraulic ram.

80. Apparatus according to claim 68 including control means programmed to carry out a predetermined operating cycle in which:

(i) the mounting structure positions the cutting device against the end face of the trench at the bottom of the trench;

(ii) the prime mover moves the cutting device forwardly a predetermined distance in the trench while operating the cutting device so as to produce an undercut in the end face of the trench, by moving the prime mover forwardly over the ground surface;

(iii) the lifting device lifts the cutting device upwardly from the undercut through the material of the end face while operating the cutting device;

(iv) the prime mover moves the cutting device rearwardly by a predetermined distance, by moving the prime mover rearwardly over the ground surface;

(v) the lifting device lowers the cutting device to the bottom of the trench; and (vi) the previous steps are repeated.

81. Apparatus according to claim 68 including:

side components adapted to engage the sides of the trench; and a powered linkage coupling the side components to the cutting device and arranged to exert a further upward force on the cutting device acting between the side components and the cutting device during the upward movement of the cutting device while the side components are engaged with the sides of the trench at a stationary position.

82. Apparatus according to claim 81 including a powered transverse component extending between the side components and arranged to press the side components outwardly against the sides of the trench during the upward cutting movement of the cutting device.

83. Apparatus according to claim 81 in which the said side components are positioned rearwardly from the cutting device.

84. Apparatus according to claim 81 including control means programmed to carry out a predetermined operating cycle in which:

(i) the mounting structure positions the cutting device against the end face of the trench at the bottom of the trench;

(ii) the prime mover moves the cutting device forwardly a predetermined distance in the trench while operating the cutting device, so as to produce the undercut in the end face of the trench, by moving the prime mover forwardly over the ground surface;

(iii) the powered transverse component presses the side components outwardly against the sides of the trench at a stationary position with the cutting device positioned against the end face of the trench;

(iv) the lifting means lifts the cutting device upwardly from the undercut through the material of the end face while operating the cutting device while the powered linkage exerts the further upward force on the cutting device;

(v) the powered transverse component releases and retracts the side components from the sides of the trench;

(vi) the prime mover moves the cutting device rearwardly by a predetermined distance by moving the prime mover rearwardly over the ground surface;

(vii) the lifting means lowers the cutting device to the bottom of the trench; and (viii) the previous steps are repeated.

* * * * *